US008659493B2

(12) United States Patent
Bosshard et al.

(10) Patent No.: US 8,659,493 B2
(45) Date of Patent: Feb. 25, 2014

(54) MISSION-FLEXIBILITY ANTENNA, SATELLITE INCLUDING SUCH AN ANTENNA AND METHOD FOR CONTROLLING THE CHANGE OF MISSION OF SUCH AN ANTENNA

(75) Inventors: Pierre Bosshard, Tournefeuille (FR); Philippe Lepeltier, Castanet (FR); Serge Depeyre, Blagnac (FR); Gilles Navarre, Toulouse (FR)

(73) Assignee: Thales, Neuilly sur Seine (FR)

( * ) Notice: Subject to any disclaimer, the term of this patent is extended or adjusted under 35 U.S.C. 154(b) by 662 days.

(21) Appl. No.: 12/817,900

(22) Filed: Jun. 17, 2010

(65) Prior Publication Data

US 2010/0321263 A1 Dec. 23, 2010

(30) Foreign Application Priority Data

Jun. 19, 2009 (FR) ..... 09 02996

(51) Int. Cl.
*H01Q 3/12* (2006.01)

(52) U.S. Cl.
USPC ..... 343/761; 343/839; 343/DIG. 2

(58) Field of Classification Search
USPC ..... 343/835, 839, 840, 776, 779, 761, 343/DIG. 2
See application file for complete search history.

(56) References Cited

U.S. PATENT DOCUMENTS

| | | | | |
|---|---|---|---|---|
| 3,534,375 | A * | 10/1970 | Stelzried et al. | 343/779 |
| 4,638,322 | A * | 1/1987 | Lamberty | 343/761 |
| 6,239,763 | B1 * | 5/2001 | Cuchanski | 343/781 P |
| 6,441,794 | B1 | 8/2002 | Tang et al. | |
| 7,598,922 | B2 * | 10/2009 | Brooks et al. | 343/880 |

FOREIGN PATENT DOCUMENTS

| | | |
|---|---|---|
| EP | 0845833 | 6/1998 |
| FR | 2648278 | 12/1990 |

* cited by examiner

*Primary Examiner* — Robert Karacsony
(74) *Attorney, Agent, or Firm* — Baker & Hostetler LLP

(57) ABSTRACT

A mission-flexibility antenna includes a reflector and at least a first source and a second source of radiofrequency signals, which sources are arranged in front of the reflector, the reflector having a focal point and each source having a phase center, and wherein the sources are independent, fixed and connected to separate radiofrequency feed systems defining different and predefined polarization and/or operating frequency characteristics, and in that it additionally includes means of displacement and orientation of the reflector from a first position in which the focal point of the reflector is placed at the phase center of the first source to a second position in which the focal point of the reflector is placed at the phase center of the second source.

10 Claims, 7 Drawing Sheets

MISSION-FLEXIBILITY ANTENNA, SATELLITE INCLUDING SUCH AN ANTENNA AND METHOD FOR CONTROLLING THE CHANGE OF MISSION OF SUCH AN ANTENNA

CROSS-REFERENCE TO RELATED APPLICATION

This application claims priority to foreign French patent application No. FR 09 02996, filed on Jun. 19, 2009, the disclosure of which is incorporated by reference in its entirety.

FIELD OF THE INVENTION

The present invention relates to an antenna with mission flexibility, in particular with regard to pointing, polarization and frequency flexibility. It relates also to a satellite including such an antenna and a method for controlling the change of mission of such an antenna.

It is notably applied in the field of satellite communications antennas.

BACKGROUND OF THE INVENTION

The increasing life of telecommunications satellites and the changes in requirements associated with the various missions that can be entrusted upon them requires that payloads, in particular antennas, of future generations of satellites are flexible. This flexibility can be achieved at the geographic coverage area level of an antenna and/or at polarization level and/or at operating frequency band level. This flexibility provides the choice of several operating configurations of the antenna and the ability to modify, in orbit, the mission of the satellite.

Antennas placed on board satellites typically include geometrically shaped reflectors illuminated by a single source to cover extensive coverage areas pointed to on Earth. An antenna subsystem generally includes one transmission and reception antenna, or one transmission antenna and one reception antenna, for each coverage area. The geometric shape of the reflector can if necessary be defined so as to be optimized for several orbital positions of the satellite.

When the pointing directions aimed at are different, but the coverage shapes are similar, it is possible to place two sources side by side at the focal point of the reflector and to geometrically shape the reflector so as to obtain a compromise in performance between the two coverage areas. The spatial decoupling of the radiated beams between the two coverage areas is hence achieved by the angular distance separating the two spot beams illuminated by the two sources. Optimizing an antenna over several coverage areas degrades the directivity performance, this degradation able to exceed 1 dB when the sources are highly defocused, which, for a conventional architecture and one with given amplifiers, results in a reduction, by the same value, of the EIRP (Effective Isotropic Radiated Power).

Moreover, it is also possible to modify and orient the pointing of a spot beam on Earth by using small antennas with mechanical pointing. However, this requires all the elements of the antenna structure, notably the reflector and the sources, to be driven mechanically, which is complex to implement and requires the use of flexible waveguides.

A change in orientation of the linear polarization of the satellite antenna or a change from a linear polarization to a circular polarization can be achieved by using two sources, for example two horns, fed with linear and circular polarizations respectively and placed in front of an oversized reflector. The two sources are positioned as close as possible to the focal point of the reflector in order to reduce losses due to the defocusing of the sources and the consequential directivity losses of the antenna. Another possibility is the use of only one source connected to a complex electrical architecture combining two radiofrequency systems, the first operating in circular polarization and the second in linear polarization. This architecture leads to reliability problems, an increase in non-negligible ohmic losses related to the complexity of the RF system and a high cost of production.

SUMMARY OF THE INVENTION

The aim of the invention is to produce an optimal antenna for meeting the requirements of flexibility in pointing, polarization and frequency, and for either suppressing losses due to defocusing when the coverages are fixed, or limiting aberrations and losses due to defocusing when the antenna must operate over coverages that can change, the corresponding spot beams being called movable spot beams.

Another aim of the invention is to produce an antenna that is simple to implement, having a geometry which does not result in a compromise related to the flexibility requirements and providing a reduction in ohmic losses as compared with the prior art solutions.

To this end, the invention relates to a mission-flexibility antenna including a single reflector and at least a first source and a second source of radio frequency signals, which sources are arranged in front of the reflector, the reflector having a focal point and each source having a phase centre, characterized in that the sources are independent, fixed and connected to separate radiofrequency feed systems defining different and predefined polarization and/or operating frequency characteristics, and in that it additionally includes means of displacement and orientation of the reflector from a first position in which the focal point of the reflector is placed at the phase centre of the first source to a second position in which the focal point of the reflector is placed at the phase centre of the second source.

Advantageously, if the flexibility concerns the frequency plan and/or polarization over the same coverage, the means of displacement and orientation of the reflector include means of actuation of the reflector according to a translation, without rotation, from the first position to the second position, the reflector being oriented into a fixed pointing direction. In that case, the phase centres of the two sources are spaced apart by a predetermined distance and the reflector is translated over a distance equal to the distance which separates the phase centres of the two sources.

Advantageously, if the flexibility concerns the frequency plan and/or polarization over different but fixed coverages, the means of displacement and orientation of the reflector include means of actuation of the reflector according to a translation combined with one or more rotations, the reflector in the second position being oriented into a pointing direction that is different from that of the reflector in the first position.

Advantageously, the means of displacement and orientation of the reflector include at least one motor connected to the reflector via at least one lever arm.

According to one embodiment of the invention, the means of displacement and orientation of the reflector include three motors interconnected by lever arms. Advantageously, the lever arms are three parts of an articulated deployment arm of the reflector.

The invention relates also to a telecommunications satellite, characterized in that it includes at least one mission-flexibility antenna.

The invention relates also to a method for controlling the change of mission of a mission-flexibility antenna, the antenna including a reflector and at least a first source and a second source of radiofrequency signals, which sources are arranged in front of the reflector, the reflector having a focal point and each source having a phase centre, characterized in that it consists in using sources that are independent, fixed and connected to separate radiofrequency feed systems defining different and predefined polarization and/or operating frequency characteristics, in selecting a source according to the type of mission desired, and then in displacing and/or orienting the reflector such that the phase centre of the selected source is positioned at the focal point of the reflector and such that the reflector illuminates a selected coverage area.

Advantageously, when the change of mission concerns the same coverage area, the displacement of the reflector is a translation, without rotation, from a first position in which the focal point of the reflector is placed at the phase centre of the first source to a second position in which the focal point of the reflector is placed at the phase centre of the second source, the translation being carried out over a distance strictly equal to the distance which separates the phase centres of the two sources.

Advantageously, when the change of mission concerns different coverage areas, the displacement of the reflector is a translation combined with one or more rotations from a first position in which the focal point of the reflector is placed at the phase centre of the first source to a second position in which the focal point of the reflector is placed at the phase centre of the second source.

Thus, flexibility of polarization and/or frequency plan and/or pointing is provided by mechanisms for displacing and orienting the reflector, such mechanisms being fitted on the deployment arm for example, which enable the focal point of the reflector to be placed at the phase centre of one of the sources.

If the pointing flexibility concerns the same coverage, the movement of the reflector, enabling a transition from the phase centre of the first source S1 to the phase centre of the second source S2, consists in translating the reflector without rotation by a distance which is strictly equal to that which separates the phase centres of the two sources.

If the flexibility requirement concerns different coverages, the relative movement of the reflector consists of a translation associated with one or more rotations.

BRIEF DESCRIPTION OF THE DRAWINGS

Other features and advantages of the invention will become clear in the following part of the description given by way of purely illustrative and non-limiting example and with reference to the accompanying drawings in which.

DETAILED DESCRIPTION

Figure 1:
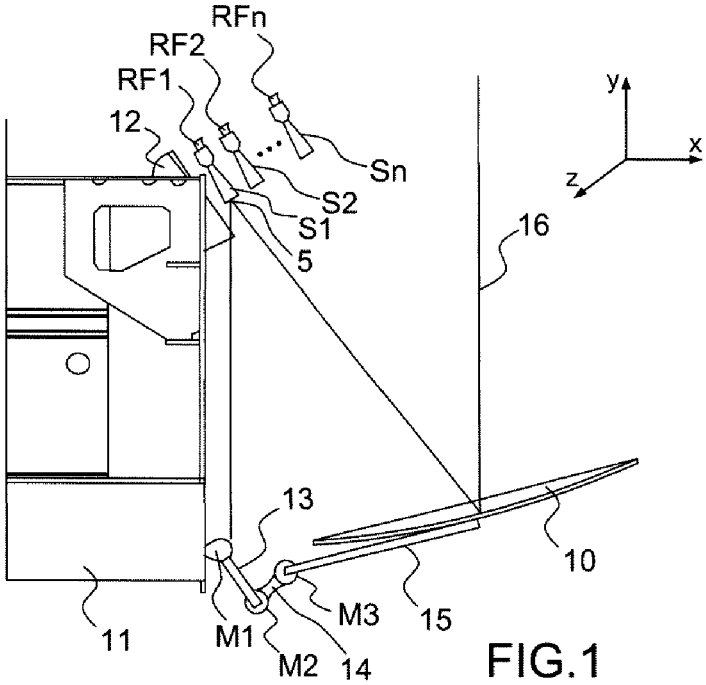
FIG. 1: a diagram of an example antenna fitted on a platform of a satellite, in the first position in which the source S1 is at the focal point of the reflector, according to the invention.

In the example represented in FIG. 1, the antenna includes a reflector 10 fitted on the platform 11 of a satellite via an articulated deployment arm 13, 14, 15 and at least two independent sources S1, S2, . . . , Sn of radiofrequency signals arranged in front of the reflector. The sources, for example of the horn type, are fixed to a support structure 12 fitted out on the platform 11 and are arranged according to a predetermined fixed configuration, for example one next to the other. The sources S1 to Sn can in some cases be placed one above the other or in any other configuration.

The antenna additionally includes at least one mechanism for displacing and orienting the reflector 10, enabling the focal point of the reflector to be placed at the phase centre of one of the sources. The mechanism for displacing and orienting the reflector, fitted for example on the deployment arm 13, 14, 15 of the reflector 10, can for example include one or more stepper motors M1, M2, M3 associated with corresponding lever arms or one stepper motor connected to a universal joint. The number of motors and the number of sources depends on the types of mission that the satellite must carry out. For example, three motors M1, M2, M3 and three sources S1, S2, Sn are represented in FIG. 1. The motor M1 is secured to the platform 11 and connected to the motor M2 by a first lever arm 13, the motors M2 and M3 are interconnected by a second lever arm 14, and the motor M3 is connected to the reflector 10 by a third lever arm 15. The first, second and third lever arms form three articulated parts of the deployment arm. The geometric shape of the reflecting surface of the reflector 10 has approximately the form of a parabola from which it differs only slightly. This shape is optimized to illuminate a coverage area on the ground having predetermined dimensions when only one source is placed at its focal point. The motors fitted on the deployment arm provide for simultaneously displacing and orienting the reflector 10 according to the mission to be carried out by the antenna, but also provide for folding the reflector back into a storage position against the platform 11 in the event of a prolonged period during which the antenna is not used.

The sources S1 to Sn can be aligned as represented, for simplification purposes, on the various drawings, or placed in two-dimensional configurations, such as for example in a triangle. When the sources are aligned, polarization and/or frequency flexibility is possible only in one plane and the coverage areas, obtained with the different sources, are aligned. When the sources are placed in two-dimensional configurations, it is possible to have polarization flexibility in several planes.

To obtain polarization and/or frequency flexibility over the same coverage area, without losses or aberrations due to defocusing, the invention consists in using several sources fed by different radiofrequency signal feed systems RF1, RF2, . . . , RFn. Since each radiofrequency system is dedicated to telecommunications functions corresponding to a predetermined polarization, it is optimal, thereby resulting in a very significant reduction in ohmic losses as compared with electrical architectures that use combinations of two radiofrequency systems. Thus, the various sources S1 to Sn can be fed in different polarizations and/or in different frequency plans. The invention then consists in selecting a source according to the type of polarization and frequency desired, and then in displacing and orienting the reflector such that the phase centre of the selected source is positioned at the focal point of the reflector and such that the reflector illuminates the selected coverage area.

Figure 4A:
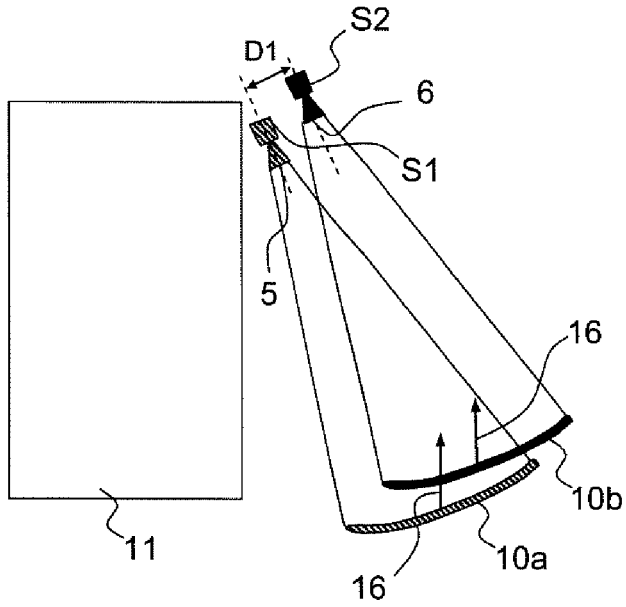
FIG. 4*a*: a diagram showing an example of identical pointing directions obtained with two different sources, according to the invention.

If the flexibility requirement concerns the same coverage area as represented in FIG. 4*a*, to change mission, the invention consists in translating, without rotation, the reflector from a first position 10*a* in which the focal point of the reflector is placed at the phase centre 5 of the first source S1 to a second position 10*b* in which the focal point of the reflector is placed at the phase centre 6 of the second source S2. The reflector translation displacement distance is strictly equal to the distance D1 which separates the phase centres 5, 6 of the two sources S1, S2.

Figure 4B:
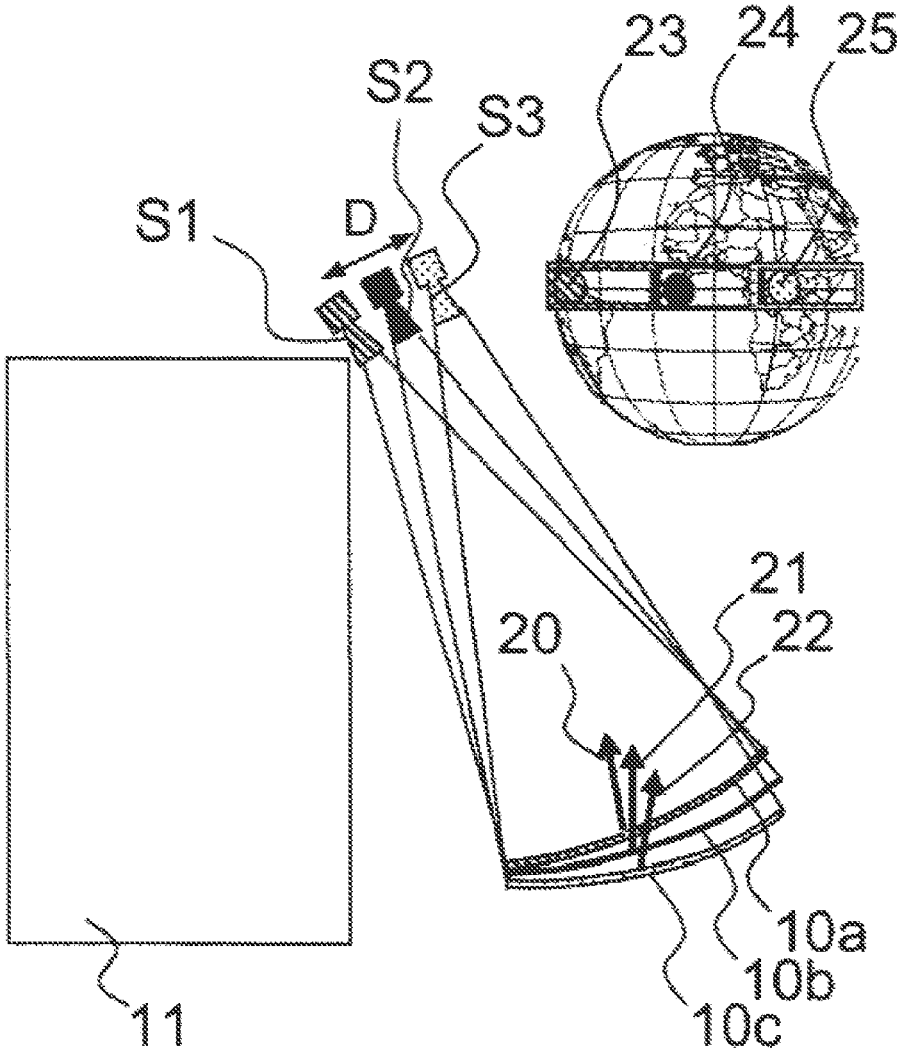
FIG. 4*b*: a diagram showing an example of coverage areas on the ground for three different pointing directions on the equator, obtained with three different sources placed successively at the focal point of the reflector, according to the invention.

If the flexibility requirement concerns different coverage areas as represented in FIG. 4*b*, to change mission, the movement of the reflector is a translation combined with one or more rotations.

By way of example, S1 can be fed in a linear polarization and operate in the Ku frequency band, S2 can be fed in a circular polarization and operate in the Ku frequency band, and S3 can be fed in a linear polarization shifted by 7.5° and operate in the Ku+ frequency band.

Figure 2A:
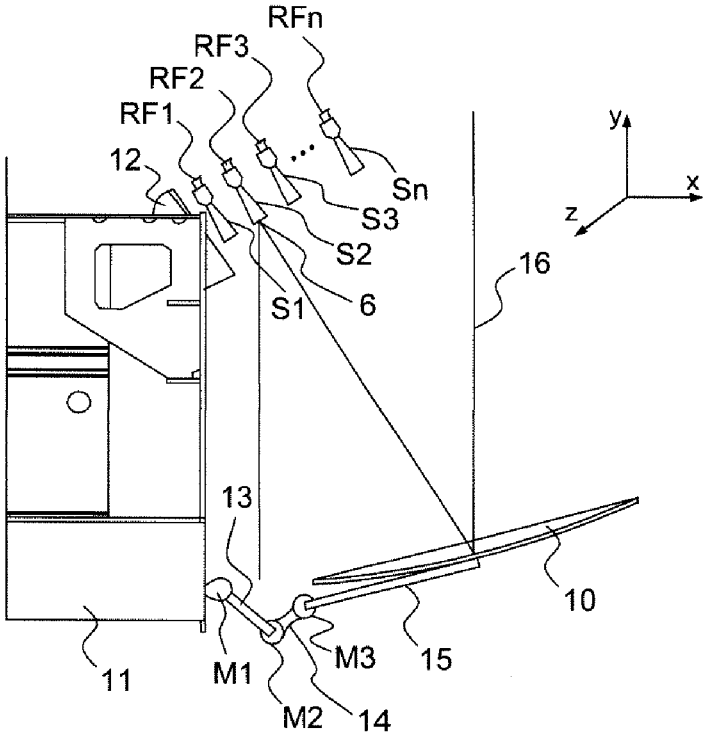
FIGS. 2*a*, 2*b*: two diagrams of the same antenna in a second position, respectively in a third position, in which the source S2, respectively the source S3, is at the focal point of the reflector for the same pointing direction, according to the invention.
Figure 2B:
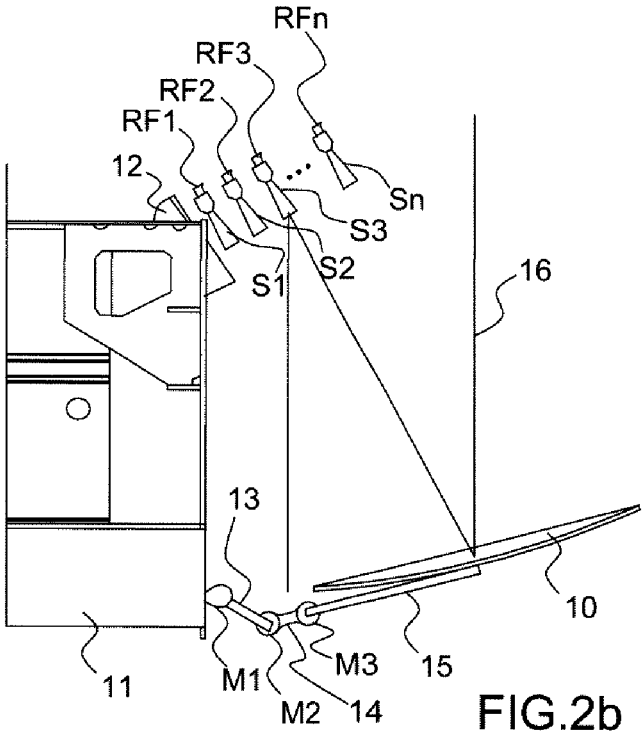

In the initial configuration represented in FIG. 1, the phase centre 5 of the source S1 is positioned at the focal point of the reflector 10 which points in a pointing direction 16 located for example on the terrestrial equator. If the source S1 is for example fed by a linearly polarized signal via a first radiofrequency system RF1 and the source S2 is for example connected to a second radiofrequency system RF2 providing a circular polarization, to change from linear polarization to circular polarization without changing the pointing of the antenna, the invention consists in switching the feed from the source S1 to the source S2 and in displacing the reflector by translation, over a distance D1, from the source S1 to the source S2 in order to position the focal point of the reflector 10 at the phase centre 6 of the source S2, as represented in FIG. 2*a*. To bring the reflector in front of the source S2 without changing the pointing direction 16 of the antenna, the invention consists in rotationally actuating the motors M1, M2, M3. To this end, as represented in the drawings, when the sources are aligned, the three motors can for example have axes of rotation that are almost parallel with each other and perpendicular to the plane of displacement of the reflector. Rotationally actuating the motor M1 in the anticlockwise direction drives the first arm 13 rotationally in the same direction, thereby having the effect of moving the motor M2, the motor M3 and the reflector 10 away from the platform 11 of the satellite and thus of displacing the reflector 10 from the source S1 to the source S2. Rotationally actuating the motors M2 and/or M3 in the clockwise direction then has the effect of swiveling the reflector 10 until it is in a position parallel to its initial position and until the phase centre 6 of the source S2 is thus positioned at the focal point of the reflector 10 and illuminates the same coverage area on Earth. The successive rotations of the various motors M1, M2 and/or M3 make the reflector 10 undergo a translation such that its focal point switches from the source S1 to the source S2. As represented in FIG. 2*b*, the same operations can be reproduced with another source such as the source S3, for example to change operating frequency plan if the source S3 is connected to a third radiofrequency system RF3 optimized for a frequency plan other than that of the sources S1 and S2.

Figure 3A:
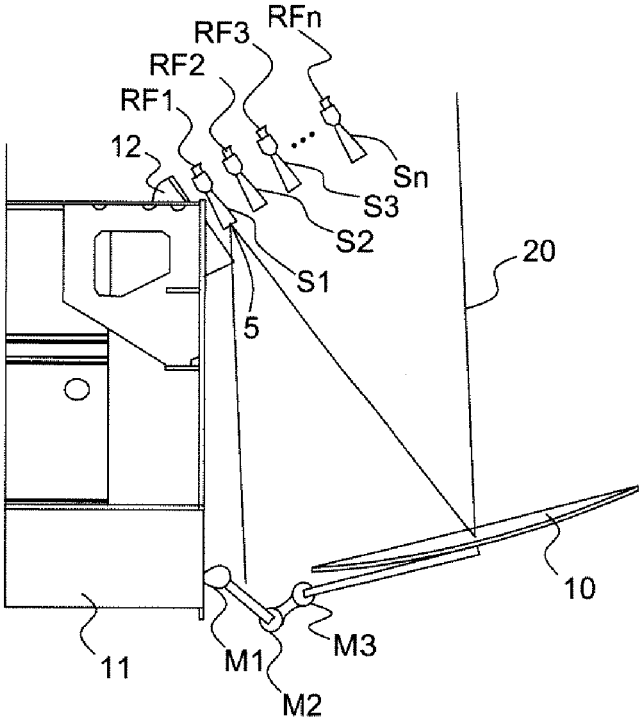
FIGS. 3*a*, 3*b*, 3*c*: diagrams of the same antenna for three different pointing directions, according to the invention.
Figure 3B:
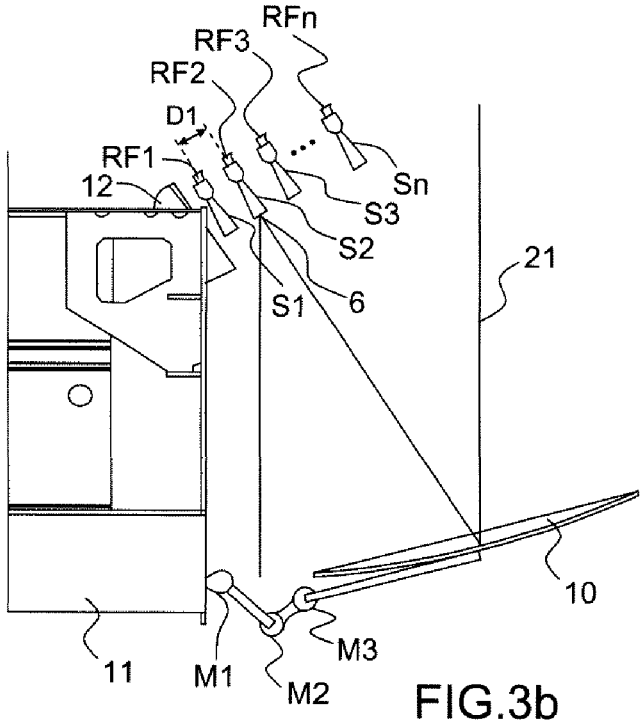
Figure 3C:
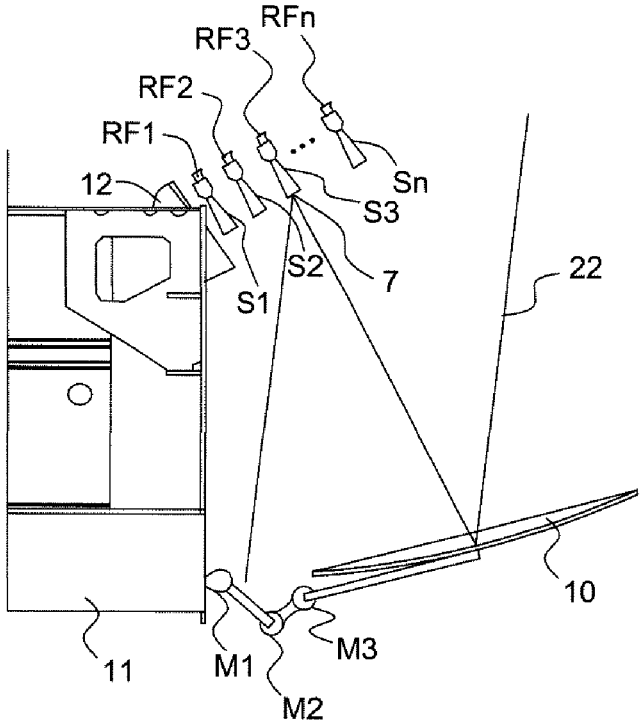

Likewise, the three motors also provide for obtaining pointing flexibility and for being able to change coverage area by changing sources, as represented in FIGS. 3*a*, 3*b*, 3*c* and FIG. 4*b*. In FIG. 3*a*, the phase centre 5 of the source S1 is placed at the focal point of the reflector 10 which points in a first direction 20 to a first area 23 for example located on the equator. To change coverage area, it is simply a matter of rotationally actuating the motor M1 to move the reflector away from the platform 11 such that the phase centre 6 of the source S2 is placed at the focal point of the reflector, and then the motors M2 and M3 to orient the reflector into a second direction of pointing 21 to a second coverage area 24, as represented in FIG. 3*b*. In this case, the reflector has undergone a translation and a rotation with respect to its initial position in FIG. 3*a* and is therefore not parallel to this initial position. The same operations on the motors M1, M2, M3 can be carried out to displace the reflector 10 towards the third source S3 such that the phase centre 7 of the source S3 is placed at the focal point of the reflector and to orient it into a third pointing direction 22 corresponding to a third coverage area 25 on the equator. FIG. 4*b* shows the three different positions 10*a*, 10*b*, 10*c* of the reflector 10 when the different sources S1, S2, S3 are placed at its focal point and for three different directions of pointing 20, 21, 22 to the equator. The coverage areas 23, 24, 25 represented in the example of FIG. 4*b* correspond to successive pointing deviations spaced apart by an angle of 3° and to a configuration in which the three sources S1, S2, S3 are aligned. The spacing D between the phase centres of the first source S1 and of the last source S3 depends directly on the focal length of the reflector 10 and on the angular separation between the coverages.

Figure 5:
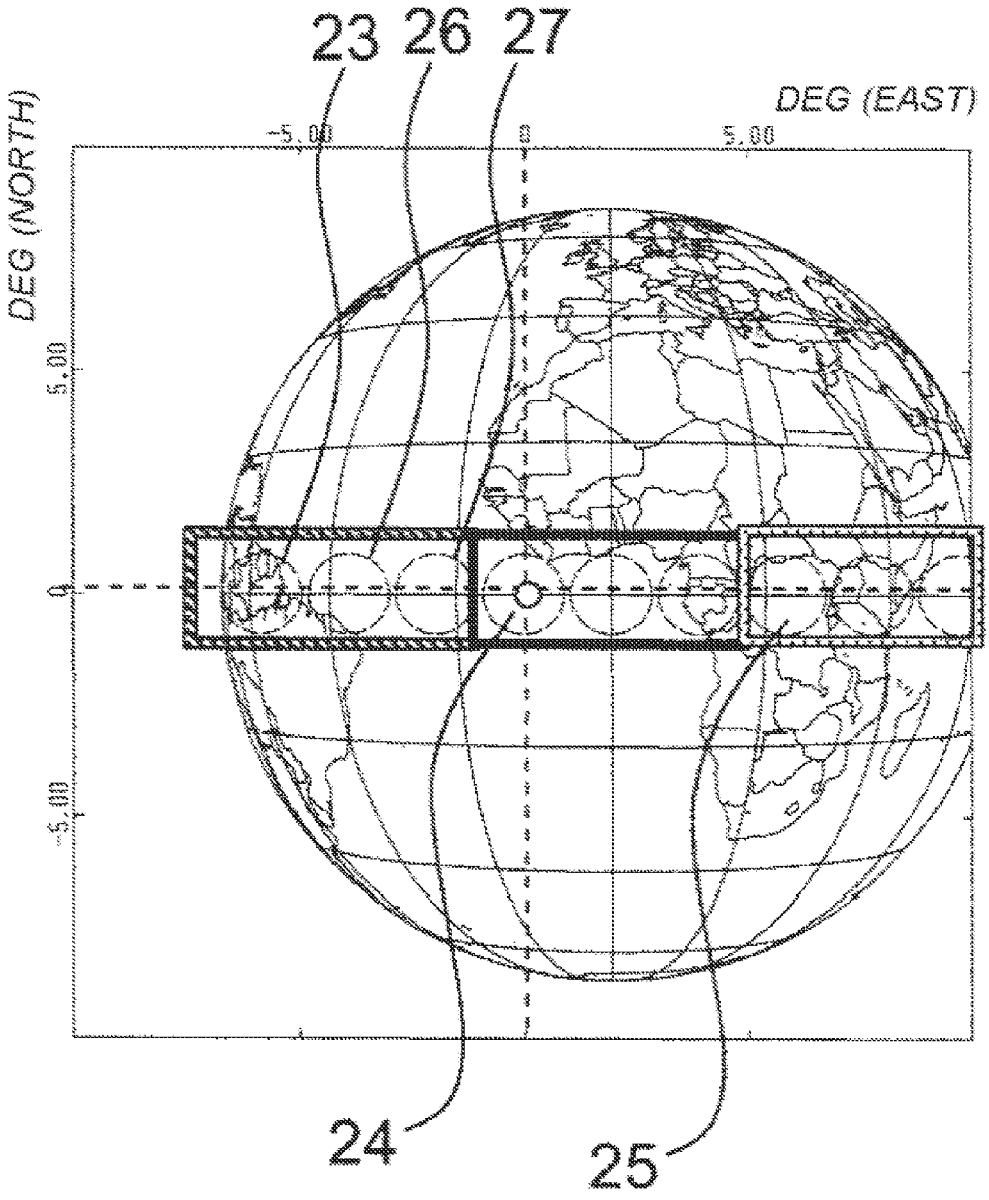
FIG. 5: a diagram showing an example of total coverage of the equator with three sources placed successively at the focal point of the reflector, according to the invention.

The three coverage areas 23, 24, 25 represented in FIG. 4*b* are not contiguous. Additional coverage areas located between the non-contiguous areas can be obtained by using the same sources S1, S2, S3 placed successively at the focal point of the reflector 10. FIG. 5 shows an example of contiguous coverage areas on the equator obtained with three sources S1, S2, S3. For example, in FIG. 5, the two areas 26, 27 located between the areas 23 and 24 can be obtained with the same source S1 placed at the focal point of the reflector 10, and by modifying only the orientation of the reflector 10 to change the pointing direction. In that case, only the motors M2 and/or M3 are rotationally actuated, the motor M1 not moving.

Figure 6:
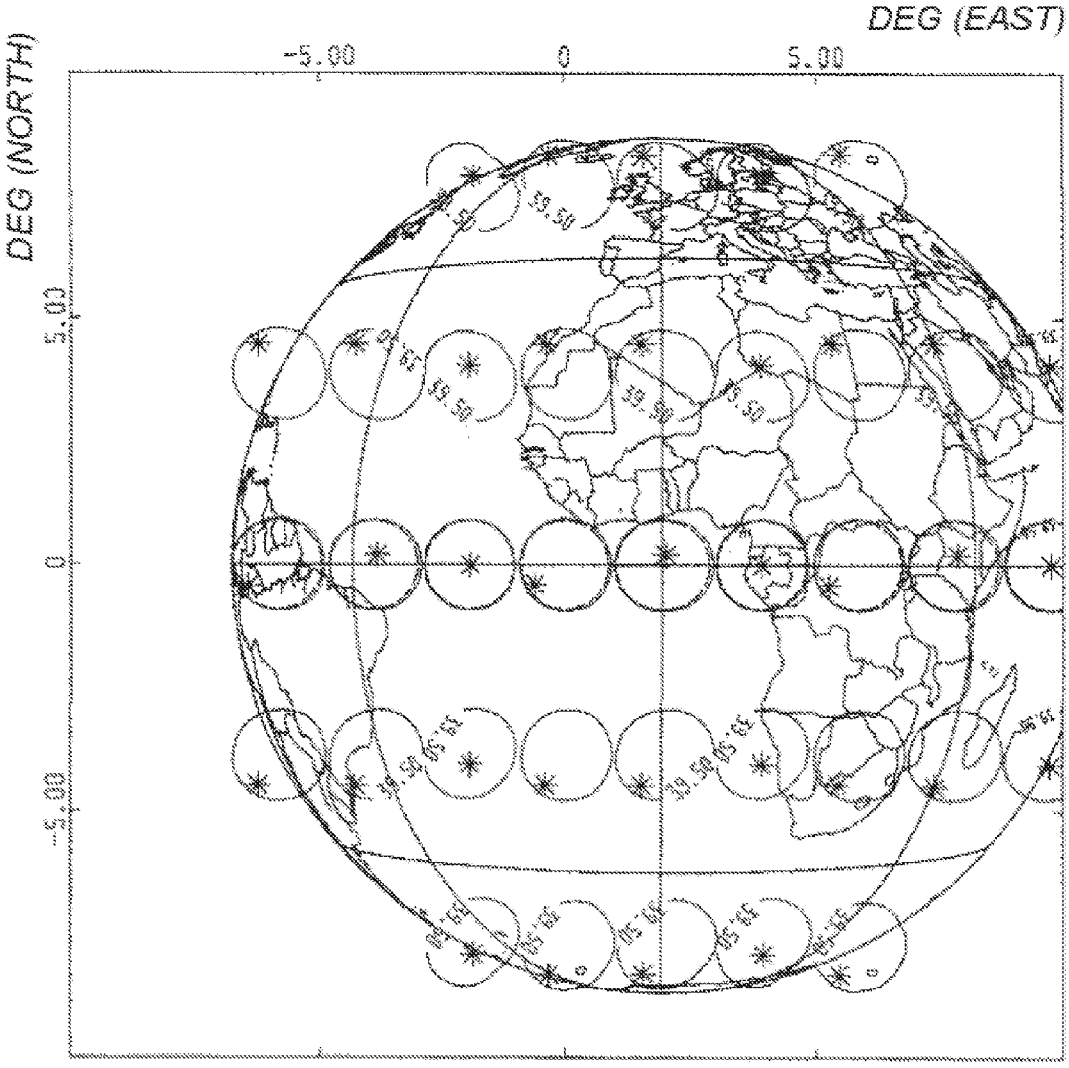
FIG. 6: a diagram showing an example of total coverage of Earth with three sources placed successively at the focal point of the reflector, according to the invention.

The three motors M1, M2, M3 provide for achieving pointing flexibility in the east-west direction. By adding a fourth motor, not represented, with an axis perpendicular to the axes of motors M1, M2, M3, it becomes possible to modify the angle of orientation of the reflector 10 in the north-south direction. By placing the focal point of the reflector 10 successively at the phase centre of each of the three sources S1, S2, S3, it is then possible to provide successive pointings in different areas located in the north-south direction and to thus achieve complete coverage of Earth as represented for example in FIG. 6.

Although the invention has been described with reference to particular embodiments, it is clearly not at all limited therein and it is clear that it comprises all the equivalent techniques of the means described and their combinations if the latter fall within the scope of the invention. Thus, for example, to actuate a reflector, it is possible to replace the three motors M1, M2, M3 by only one motor associated with a universal joint.

What is claimed is:

1. A mission-flexibility antenna including a single reflector and at least a first source and a second source of radio frequency signals, which sources are arranged in front of the reflector, the reflector having a focal point and each source having a phase centre, wherein the sources are independent, fixed and connected to separate radiofrequency feed systems defining different and predefined polarization and/or operating frequency characteristics, wherein said antenna additionally includes means of displacement and orientation of the reflector from a first position in which the focal point of the reflector is placed at the phase centre of the first source to a second position in which the focal point of the reflector is placed at the phase centre of the second source, and wherein the means of displacement and orientation of the reflector include means of actuation by translation of the reflector from the first position to the second position, the reflector being oriented into a fixed pointing direction, wherein the translation consists in moving the reflector in a linear direction.

2. The antenna according to claim 1, wherein the phase centres of the two sources are spaced apart by a predetermined distance and in that the reflector is translated over a distance equal to the distance which separates the phase centres of the two sources.

3. The antenna according to claim 1, wherein the means of displacement and orientation of the reflector include means of actuation by translation combined with one or more rotations of the reflector, the reflector in the second position being oriented into a second pointing direction that is different from a first pointing direction of the reflector in the first position.

4. The antenna according to claim 1, wherein the means of displacement and orientation of the reflector include at least one motor connected to the reflector via at least one lever arm.

5. The antenna according to claim 3, wherein the means of displacement and orientation of the reflector include three motors interconnected by lever arms.

6. The antenna according to claim 5, wherein the lever arms are three parts of an articulated deployment arm of the reflector.

7. A telecommunications satellite including at least one antenna according to claim 1.

8. A method for controlling a change of mission of a mission-flexibility antenna according to claim 1, the antenna including a reflector and at least a first source and a second source of radio frequency signals, which sources are arranged in front of the reflector, the reflector having a focal point and each source having a phase centre, the method comprising: using independent sources that are fixed and connected to separate radiofrequency feed systems defining different and predefined polarization and/or operating frequency characteristics; selecting a source according to the type of mission desired; and at least one of displacing and orienting the reflector such that the phase centre of the selected source is positioned at the focal point of the reflector and such that the reflector is oriented into a chosen pointing direction and illuminates a corresponding coverage area.

9. The method according to claim 8, wherein when the change of mission concerns the same coverage area, the displacement of the reflector is a translation, without rotation, from a first position in which the focal point of the reflector is placed at the phase centre of the first source to a second position in which the focal point of the reflector is placed at the phase centre of the second source, the translation being carried out over a distance strictly equal to the distance which separates the phase centres of the two sources.

10. The method according to claim 8, wherein when the change of mission concerns different coverage areas, the displacement of the reflector is a translation combined with one or more rotations from a first position in which the focal point of the reflector is placed at the phase centre of the first source to a second position in which the focal point of the reflector is placed at the phase centre of the second source.

* * * * *